US007542690B2

(12) United States Patent
Sugaya et al.

(10) Patent No.: US 7,542,690 B2
(45) Date of Patent: Jun. 2, 2009

(54) COLOR IMAGE FORMING APPARATUS, AND PROGRAM AND METHOD OF CONTROLLING A COLOR IMAGE FORMING APPARATUS

(75) Inventors: Hajime Sugaya, Tokyo (JP); Hiroaki Ogata, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/197,815

(22) Filed: Aug. 25, 2008

(65) Prior Publication Data

US 2008/0317492 A1 Dec. 25, 2008

Related U.S. Application Data

(63) Continuation of application No. 11/299,585, filed on Dec. 12, 2005, now Pat. No. 7,430,382.

(30) Foreign Application Priority Data

Dec. 17, 2004 (JP) ..... 2004-366098

(51) Int. Cl.
*G03G 15/16* (2006.01)

(52) U.S. Cl. ..... 399/66; 399/299; 399/302

(58) Field of Classification Search ..... 399/66, 399/82, 298, 299, 302; 347/116, 117
See application file for complete search history.

(56) References Cited

U.S. PATENT DOCUMENTS 6,088,567 A * 7/2000 Miyashiro et al. ..... 399/400
6,125,247 A * 9/2000 Tsukida et al. ..... 399/66
6,324,358 B1 * 11/2001 Sahara ..... 399/66
6,724,410 B2 * 4/2004 Arai ..... 347/115
6,963,715 B2 * 11/2005 Kanekura et al. ..... 399/299
7,113,714 B2 * 9/2006 Taguchi et al. ..... 399/66
7,430,382 B2 * 9/2008 Sugaya ..... 399/66
2003/0223785 A1 * 12/2003 Kanekura et al. ..... 399/299

FOREIGN PATENT DOCUMENTS

JP 2003285477 A * 10/2003
JP 2004004398 A * 1/2004

* cited by examiner

*Primary Examiner*—Robert Beatty
(74) *Attorney, Agent, or Firm*—Canon USA Inc IP Div

(57) ABSTRACT

In a color image forming apparatus, a color mode is switched from a full color mode to a single color mode as follows. When the length of an image of a last page in the full color mode is less than the distance from a first-transferring position of a most downstream image forming station to a second-transferring position, if the time interval from arrival of the trailing end of an image of a page immediately previous to the last page at the second-transferring position to arrival of the leading end of the image of the last page at the second-transferring position is longer than the time needed to separate color image forming stations from the second image carrying medium, then the separating operation is started when the trail end of the image of the page immediately previous to the last page in the full color mode reaches the second-transferring position.

2 Claims, 10 Drawing Sheets

| |
|---|
| FIG. 3A |
| FIG. 3B |
| FIG. 3C |

COLOR IMAGE FORMING APPARATUS, AND PROGRAM AND METHOD OF CONTROLLING A COLOR IMAGE FORMING APPARATUS

CROSS-REFERENCE TO RELATED APPLICATIONS

This application is a continuation of U.S. patent application Ser. No. 11/299,585 filed Dec. 12, 2005, which claims the benefit of Japanese Application No. 2004-366098 filed Dec. 17, 2004, all of which are hereby incorporated by reference herein in their entirety.

BACKGROUND OF THE INVENTION

1. Field of the Invention

The present invention relates to a color image forming apparatus using electrophotography, and more particularly, to a technique to minimize a waiting time that occurs when a color mode is switched between a full color mode and a single color mode. The image forming apparatus refers to an apparatus for forming an image on a recording medium by using electrophotography. Specific examples of such image forming apparatus include an electrophotographic copying machine, an electrophotographic printer (such as a laser beam printer, an LED printer, etc.), a facsimile machine, and a word processor.

2. Description of the Related Art

An image forming apparatus having an in-line second image carrying medium is known as one of color image forming apparatus using an electrophotographic process. As shown in FIG. 1, this type of image forming apparatus has image forming stations 10 (10Y, 10M, 10C, and 10Bk) for forming toner images of respective different plural colors. Each image forming station 10 (10Y, 10M, 10C, or 10Bk) has a photosensitive drum serving as a first image carrying medium 1 (1Y, 1M, 1C, or 1Bk) and a developing unit. The image forming stations 10 are arranged in line such that they face a second image carrying medium 7. The toner images of respective colors are transferred to the second image carrying medium 7 such that a multi-layer full-color toner image is formed on the second image carrying medium 7. The multi-layer full-color toner image formed on the second image carrying medium 7 is transferred to a recording medium 13 by a second-transferring device 8. This type of image forming apparatus has an advantage in that a high-quality image can be formed on a recording medium regardless of the type of the recording medium. Another advantage is that a full color image can be formed at a high speed. Because of these advantages, this type of image forming apparatus is widely used.

When a single color image is formed using the image forming apparatus having the in-line second image carrying medium, it is known to separate the photosensitive drums 1 (1Y, 1M, and 1C) of color image forming stations from the second image carrying medium 7 as shown in FIG. 2 such that the photosensitive drums 1 (1Y, 1M, and 1C) of the color image forming stations are not used when a single color image is formed. This method allows for disengagement of the photosensitive drums of the color image forming stations in the single color mode.

Japanese Patent Laid-Open No. 2004-004398 (corresponding to U.S. patent application publication No. 2003-0223785 A1) discloses a technique to reduce usage of photosensitive drums of color image forming stations during the process of forming a single color image. In this technique, after first transferring of all toner images is completed for a last page in a particular print job and before second-transferring is started, photosensitive drums (Y, M, C, and Bk) are separated from the second image carrying medium when second transferring for a page immediately previous to the last page is completed. This makes it possible to reduce the usage of the photosensitive drums without causing a color registration error when second transferring is performed. However, in this technique, it is needed to perform the separating operation when there is no toner image at the second-transferring position, and thus the time interval between the trailing end of one sheet and the leading end of a following sheet must be longer than the time needed to perform the separating operation.

Nowadays, it is very common to connect a printer or a copying machine having a printing function to a network so that a plurality of users can use the printer. In such an environment, various print requests are issued by various users at the same time, and thus it is needed to print full color images in the middle of a single color print job or vice versa.

It is needed to switch the color mode such that no color registration error occurs when the color image forming stations 10 (10Y, 10M, and 10C) are separated from or are brought into contact with the second image carrying medium 7. More specifically, when the color mode is switched from the full color mode to the single color mode, it is needed to perform the separation (or contacting) operation between the color forming stations 10 (10Y, 10M, and 10C) and the second image carrying medium 7 when a full color image formed on the image carrying medium 7 (or a single color image in the case where the color mode is switched from the single color mode to the full color mode) does not exist at the first-transferring position of the black image forming station 10Bk and does not exist at the second-transferring position.

In the conventional technique, to meet the above requirement, when the color mode is switched from the full color mode to the single color mode, the color image forming stations 10 (10Y, 10M, and 10C) are separated from (or brought into contact with) the second image carrying medium 7 after a full color image (or a single color image in the case in which the color mode is switched from the single color mode to the full color mode) formed on the second image carrying medium 7 has passed through the second-transfer position. Thereafter, forming of an image in the single color mode (or the full color mode) is started (FIG. 5). In this technique, however, if the color mode is changed frequently, a reduction in the throughput of the printing operation occurs.

SUMMARY OF THE INVENTION

The present invention is directed to a color image forming apparatus capable of switching the color mode without causing a color registration error and without causing a reduction in throughput.

According to one aspect of the present invention, there is provided an image forming apparatus including a plurality of image forming stations, each image forming station configured to form a color toner image, the color of the toner images being different among the plurality of image forming stations; first transferring parts and a second image carrying medium, the first transferring part configured to sequentially transfer the color toner images formed by the respective image formation stations to the second image carrying medium; a second transferring part adapted to transfer, in a second transfer process, the color toner images on the second image carrying medium to a recording medium; and a controller adapted to selectively switch a color mode between a full color mode, in which a full color image using plural color toner images formed on the second image carrying medium, and a single color mode, in which a single color image using a single color toner image formed on the second image carrying medium. The controller controls the switching of the color mode by determining, based on an interval between an image of interest and an immediately previous image, whether there is an image of interest between a most downstream first transferring part and the second transferring part and whether it is possible to switch the color mode in a state in which the first transferring part and the second-transferring part are not in operation. If the determination is affirmative, the controller switches the color mode after the second transferring process for the immediately previous image is completed and before the second transferring process for the image of interest is started. If the determination is negative, the controller switches the color mode after the image of interest completely passes through the second transferring part.

According to another aspect of the present invention, there is provides a method of controlling the above disclosed image forming apparatus including the steps of determining, based on an interval between an image of interest and an immediately previous image, whether there is an image of interest between a most downstream first transferring part and the second transferring part and whether it is possible to switch the color mode in a state in which the first transferring parts and the second transferring part are not in operation. If the determination is affirmative, switching the color mode after the second transferring process for the immediately previous image is completed and before the second transferring process for the image of interest is started. If the determination is negative, switching the color mode after the image of interest has completely passed through the second transferring part.

As described above, the present invention provides a color image forming apparatus capable of switching the color mode between the full color mode and the single color mode without causing a color registration error and without causing a reduction in the throughput.

Further features of the present invention will become apparent from the following description of exemplary embodiments with reference to the attached drawings.

DESCRIPTION OF THE EMBODIMENTS

The present invention is described in further detail below with reference to specific embodiments. Note that in these embodiments, specific dimensions, materials, shapes, and relative positions of parts are described by way of example but not limitation. That is, the invention is not limited to the details of these specific examples unless otherwise stated. Also note that in these embodiments, when similar parts are described a plurality of times, it is assumed that dimensions, materials, shapes, and relative positions of parts are similar to those described first.

First Embodiment

Figure 1:
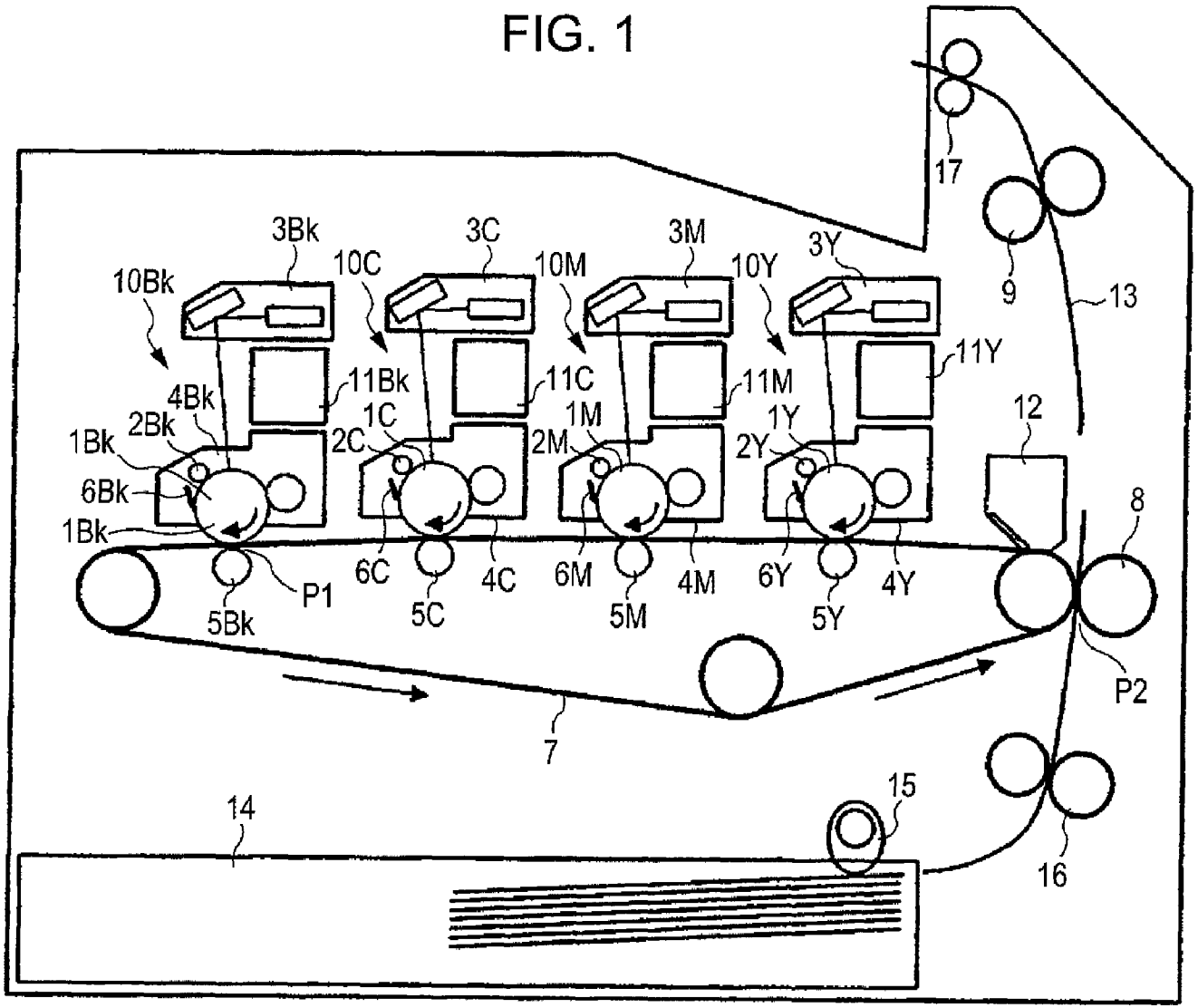
FIG. 1 is a cross-sectional view of a color image forming apparatus according to an embodiment of the present invention.

FIG. 1 is a cross-sectional view showing a general structure of a color image forming apparatus according to a first embodiment of the invention. The color image forming apparatus (hereinafter, also referred to simply as the image forming apparatus) according to the present embodiment includes image forming stations 10 (10Y, 10M, 10C, and 10BK) each including a first image carrying medium (also referred to as a photosensitive drum) 1 (1Y, 1M, 1C, and 1BK) on which an electrostatic latent image corresponding to one of a plurality of colors is formed and carried, a developing unit 4 for developing the electrostatic latent image, a second image carrying medium 7 to which developer images of respective colors are transferred in a layer-on-layer fashion from the respective first image carrying mediums 1, and a second-transferring device 8 for transferring the color developer image formed on the second image carrying medium 7.

In the image forming apparatus, photosensitive drums 1 (1Y, 1M, 1C, and 1Bk) are rotatably supported. When an image forming process is started, charging rollers 2 (2Y, 2M, 2C, and 2Bk) serving as charging units uniformly charge the surface of the photosensitive drums 1 (1Y, 1M, 1C, and 1Bk). Thereafter, laser illumination units 3 (3Y, 3M, 3C, and 3Bk) serving as exposing units illuminate the surface of the photosensitive drums 1 (1Y, 1M, 1C, and 1Bk) with laser light corresponding to image information of respective colors so as to form electrostatic latent images on the photosensitive drums 1 (1Y, 1M, 1C, and 1Bk).

In the present embodiment, the photosensitive drums 1 (1Y, 1M, 1C, and 1Bk) are charged negatively, and the electrostatic latent images corresponding to image information are formed by reducing negative charges on the photosensitive drums 1 (1Y, 1M, 1C, and 1Bk) according to image information by illuminating the photosensitive drums 1 (1Y, 1M, 1C, and 1Bk) with laser light emitted by the laser illumination units 3 (3Y, 3M, 3C, and 3Bk).

When the photosensitive drums 1 (1Y, 1M, 1C, and 1Bk) rotate, the electrostatic latent images are converted into visual images by toner serving as developers supplied by developing units 4 (4Y 4M, 4C, and 4Bk). Thus, toner images are formed on the respective photosensitive drums 1 (1Y, 1M, 1C, and 1Bk). The toner images of respective colors are sequentially transferred to the second image carrying medium 7 by first transferring devices 5 (5Y, 5M, 5C, and 5Bk) corresponding to the respective photosensitive drums 1 (1Y, 1M, 1C, and 1Bk). After transferring of toner images is completed, toner remaining on the surface of the photosensitive drums 1 (1Y, 1M, 1C, and 1Bk) is removed by cleaning devices 6 (6Y, 6M, 6C, and 6Bk) each having a cleaning blade.

In the present embodiment, reverse developing is employed. In the reverse developing, toner is charged to the same polarity as the polarity (negative polarity) of charging of the photosensitive drums 1 (1Y, 1M, 1C, and 1Bk), and negatively charged toner adheres to portions, where negative charges are reduced in accordance with image information, of the surface of the photosensitive drums 1 (1Y, 1M, 1C, and 1Bk).

For each color, one photosensitive drum 1, one charging roller 2, one developing unit 4, and one cleaning device 6 are integrated into a process cartridge (image forming stations)

10 (10Y, 10M, 10C, or 10Bk) of one color such that the image forming stations 10 (10Y, 10M, 10C, and 10Bk) are individually removable from the main part of the image forming apparatus for the purpose of replacement. Toner is supplied to the developing units 4 (4Y, 4M, 4C, and 4Bk) from corresponding toner supply units 11 (11Y, 11M, 11C, and 11Bk) serving as developer containers.

Recording media 13 placed in a recording medium cassette 14 are fed one by one by a paper feed roller 15. In synchronization with the image formed on the second image carrying medium 7, the recording medium 13 is transported by a registration roller 16 to a second-transferring position P2, at which the recording medium 13 is pinched between the second image carrying medium 7 and a transfer roller 8 serving as the second-transferring device.

When the toner image on the second image carrying medium 7 and the recording medium 13 reach the second-transferring position P2, the toner image is transferred to the recording medium 13 by a transfer electric field formed at the transfer position by the transfer roller 8. Thereafter, the toner image transferred to the recording medium 13 is fused by heat applied by a fusing roller (heating roller) of a fuser 9 and by a pressure applied by a pressing roller such that a permanent image is formed on the recording medium 13.

Figure 2:
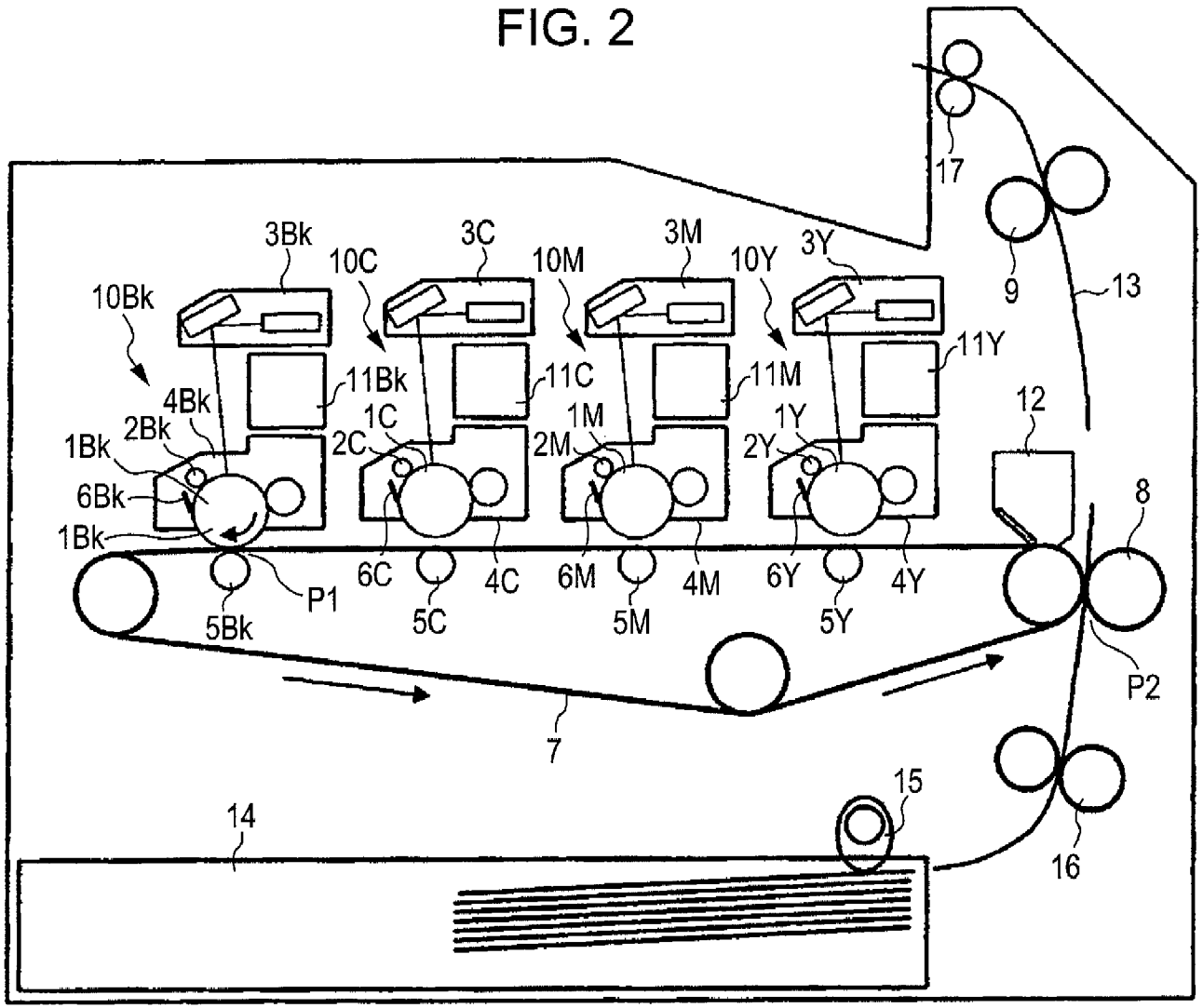
FIG. 2 is a diagram showing a process of separating color image forming stations from a second image carrying medium according to an embodiment of the present invention.

When a single color image is formed (in the single color mode), the color photosensitive drums 1 (1Y, 1M and 1C) of respective color process cartridges 10 (10Y, 10M, and 10C) are separated from the second image carrying medium 7 as shown in FIG. 2 such that the single color image is formed without driving the color process cartridges 10 (10Y, 10M, and 10C).

Figure 6:
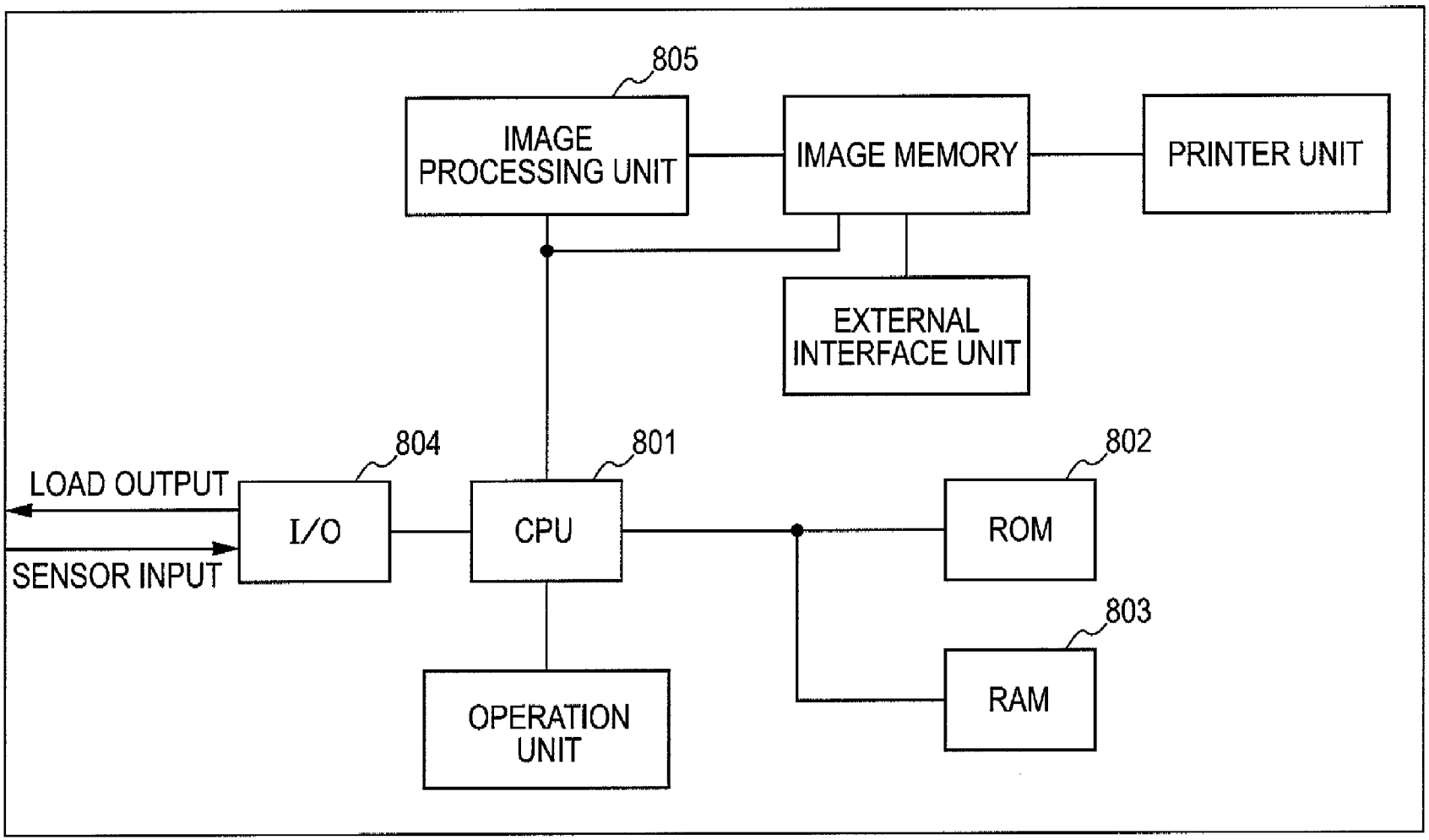
FIG. 6 is a block diagram showing a control system according to an embodiment of the present invention.

In the present embodiment, as shown in FIG. 6, a control system includes a CPU 801, a ROM 802 in which a control program is stored, a RAM 803 used as a work area by the CPU 801 in various processes, and an image processing unit 805 for processing image data. The control system controls the sequence of image forming processes described above and also controls switching of the color mode as will be described later. The other parts of the control system shown in FIG. 6 have no direct relation to the present embodiment of the invention, and thus explanation of them is omitted.

Parameters associated with main parts of the image forming apparatus according to the present embodiment are as follows.

The distance from the first transfer position P1 of the most downstream image forming station (Bk) to the second-transferring position P2 is A=525 mm.

The time needed to separate the color image forming stations from the second image carrying medium is T=0.4 sec.

The processing speed (the surface moving velocity of the second image carrying medium) is V=150 mm/sec.

When A3-size recording media are successively printed in portrait format, the image length B0 (=B1, B2 and so on) of respective pages is assumed to be 420 mm.

The interval from the leading end of one image to that of a next image is Tt1=3.4 sec.

Note that when the parameters are assumed to have the above-described values, A>B0 (A=525 mm and B0=420 mm).

The control of switching of the color mode is described in detail below.

Figures 3, 3A:
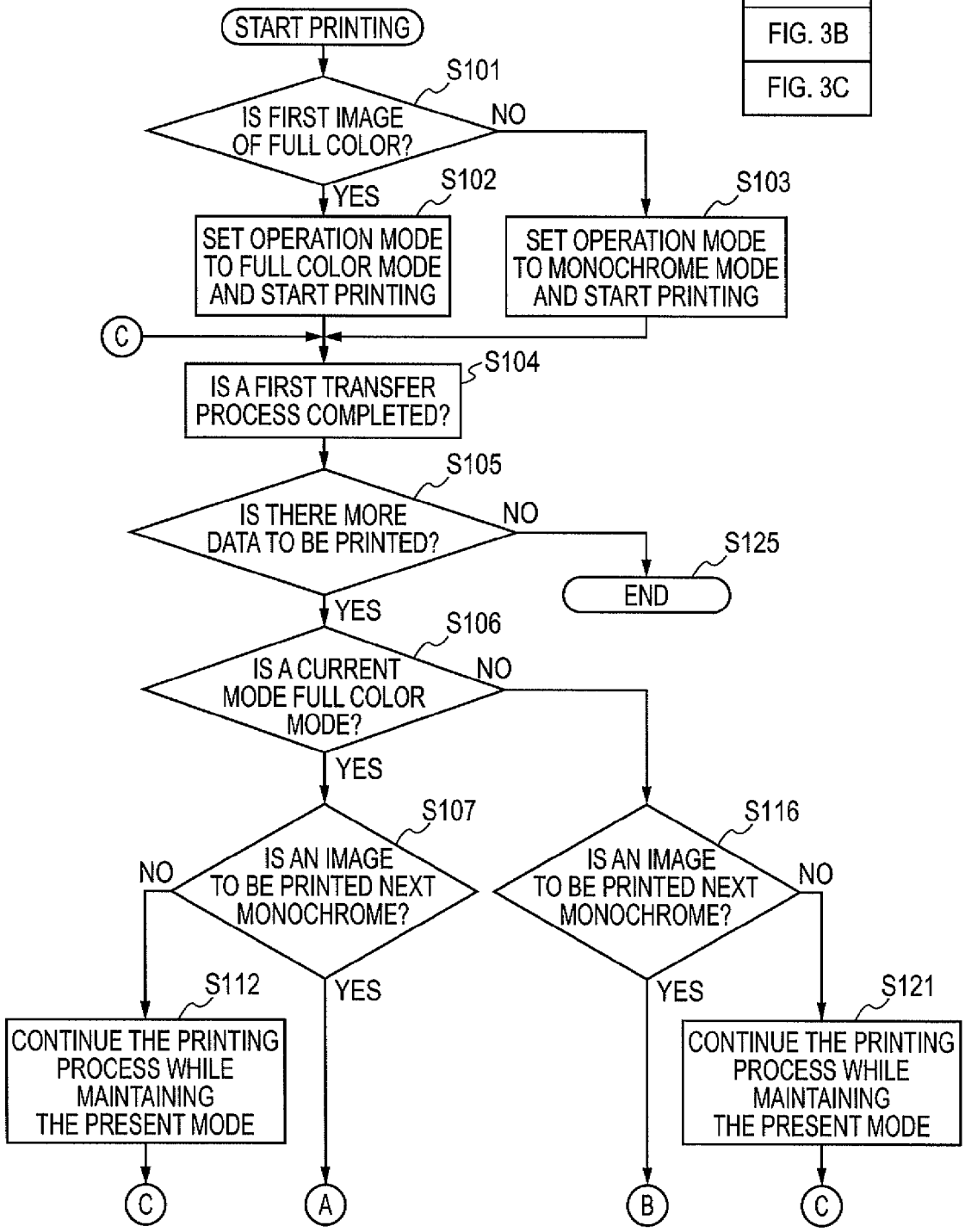
FIGS. 3A to 3C are flowcharts showing a process according to an embodiment of the present invention.
Figure 3B:
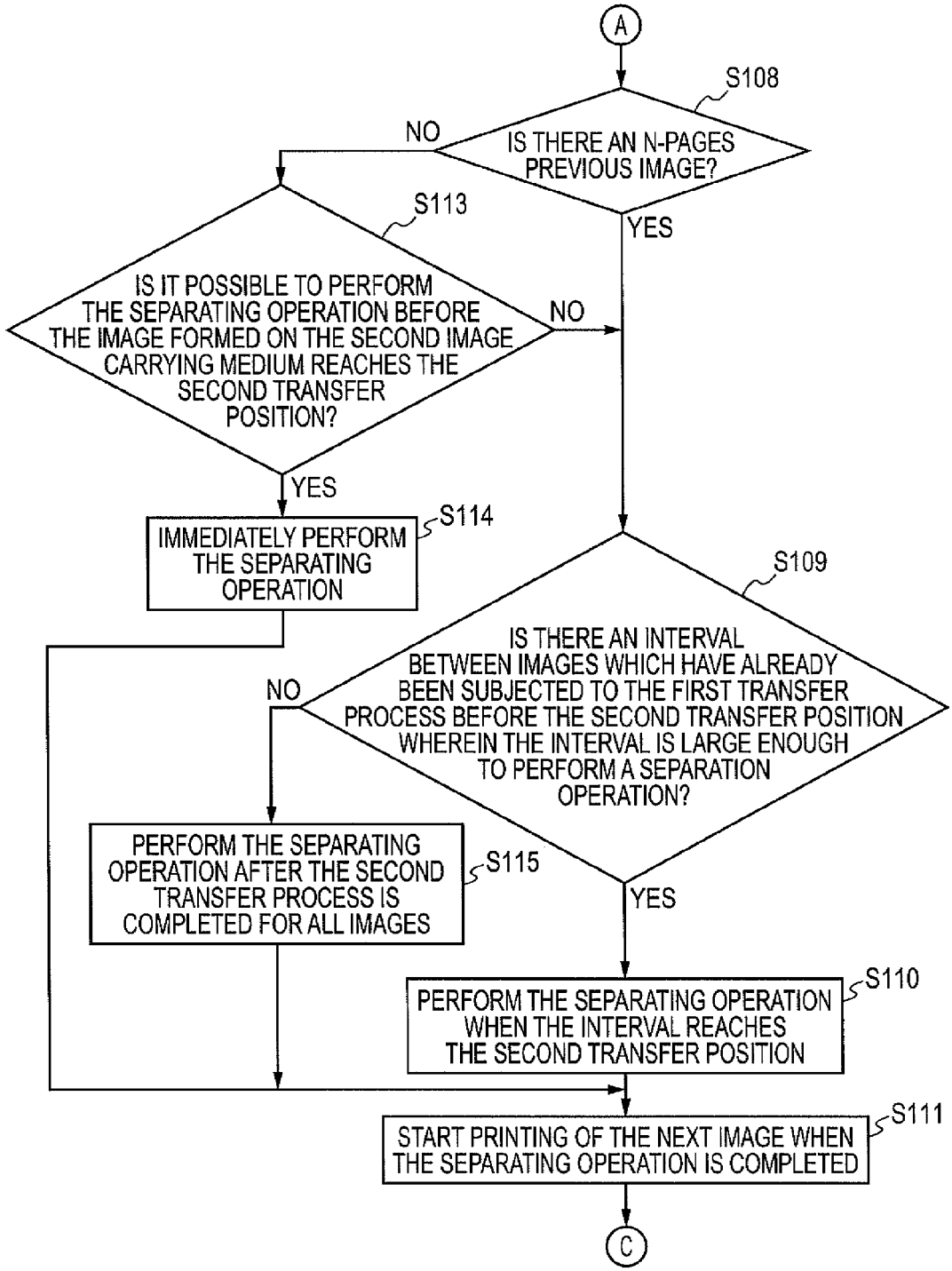
Figure 3C:
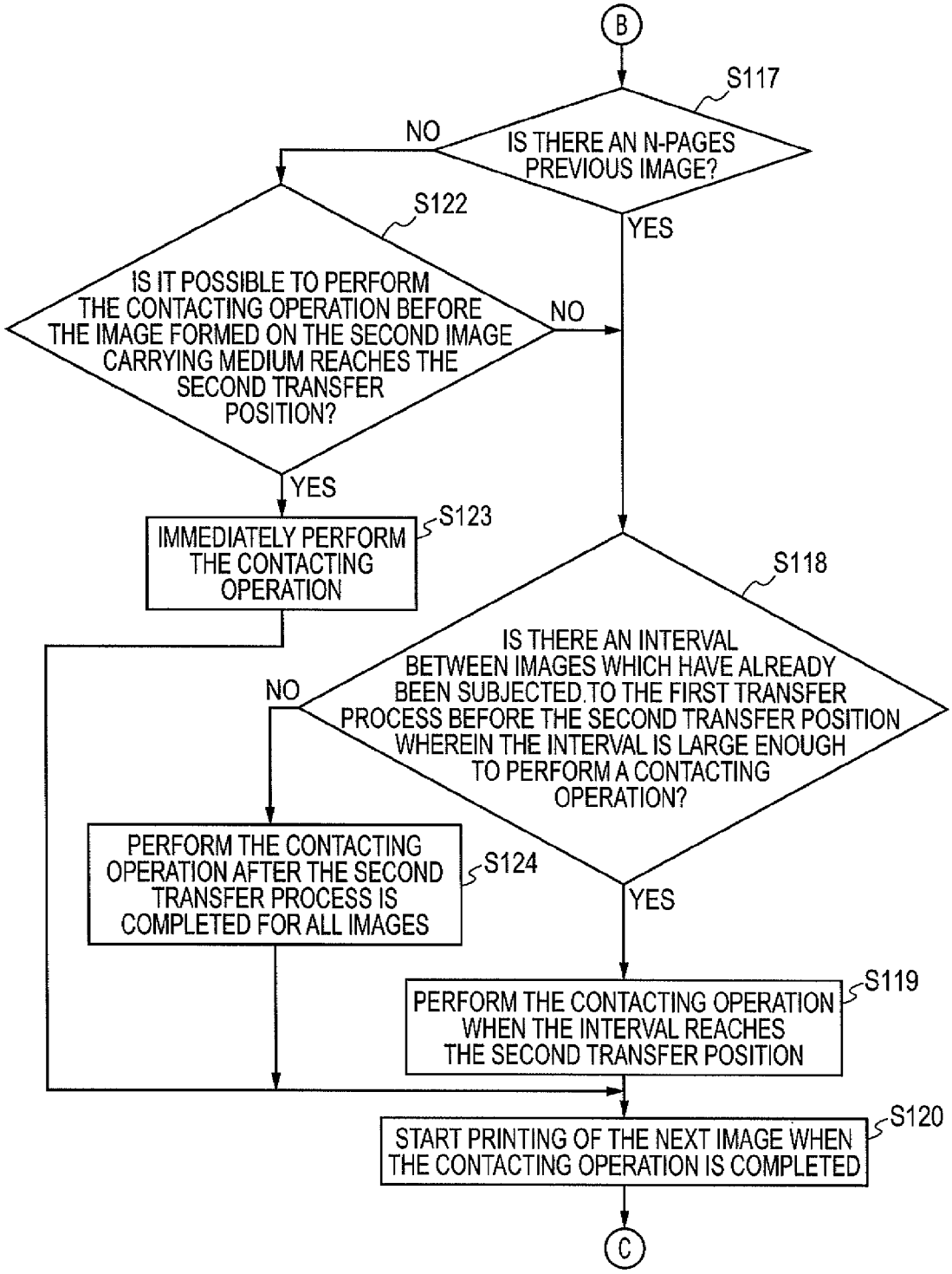

FIGS. 3A to 3C are flowcharts showing a process of controlling the switching of the color mode. FIGS. 4A to 4C and FIGS. 5A and 5C are diagrams illustrating the control process.

If the image forming apparatus receives a print command issued by a user, the image forming apparatus starts a printing operation. First, image data given by the user is converted by the image processing unit 805 into printable forms of respective colors. A determination is then made as to whether a first image is of full color (step S101). If the first image is of full color, the color mode of the printing operation is set to a full color mode (step S102). In the present embodiment, the printing operation is performed either in the full color mode in which the color image forming stations are kept in contact with the second image carrying medium or in a single color mode in which the color image forming stations are separated from the second image carrying medium. In a case in which it is determined in step S101 that the first image is a single color image, the color mode is set to a single color (monochrome) mode (step S103). After the color mode for the first image is set, an image forming sequence is selected depending on the selected color mode.

If a first transferring process for the current image is completed (step S104), it is determined whether there is another image to print next (step S105). If there is no image, the printing is ended (step S125).

If there is another image to print next, the process proceeds to step S106. In step S106, the color mode for the next image is determined.

In a case in which the color mode for the present image is the same as that for the image to be formed next, the printing for the next image is performed without changing the color mode (steps S107 and S112 or steps S116 and S121). If the color mode for the next image is different from that for present image (that is, if the answer to step S107 is yes or if the answer to step S116 is yes), the color image forming stations are separated from (or brought into contact with) the second image carrying medium as described below.

First, the minimum value of N satisfying the following condition is determined (S108 or S117).

$$A \leqq (Tt1 + \ldots + TtN) \times V + B0$$

In this specific case, A (=525 mm)≦(Tt1)×V+B0 (=930 mm), and thus the minimum value of N is 1. A comparison with the separation (contacting) operation time T is then performed. If it is assumed that M=1 (=N), and T is compared with smaller one of the following values, $$(A-B0)/V=0.7 \text{ sec}$$

$$Tt1-B1/V=0.6 \text{ sec}$$

then $$T=0.4 \text{ sec} \leqq Tt1-B1/V=0.6 \text{ sec}$$

Thus, the color image forming stations are separated from (brought into contact with) the second image carrying medium when the interval for an M (=1)-page previous page reaches the second-transferring position P2 (in steps S109 and S110 or in S118 and S119).

In a case in which the present operation status is that the first transferring process is completed for the image of the first page and there is no previous image, T satisfies the following condition.

$$T=0.4 \text{ sec} \leqq (A-B0)/V=0.7 \text{ sec}$$

That is, the time needed for the first-transferred image to reach the second-transferring position P2 is 0.7 sec, which is greater than T. Thus, the separating operation is immediately performed (steps S113 and S114 or steps S122 and S123).

If the condition is not satisfied, the separating (contacting) operation is performed after the second transferring process is completed for all images (step S115 or S124).

After the separating (contacting) operation is completed, the process of forming the next image is started (step S111 or S120). The above-described process is performed repeatedly until the process is completed for all print jobs.

Figure 4A:
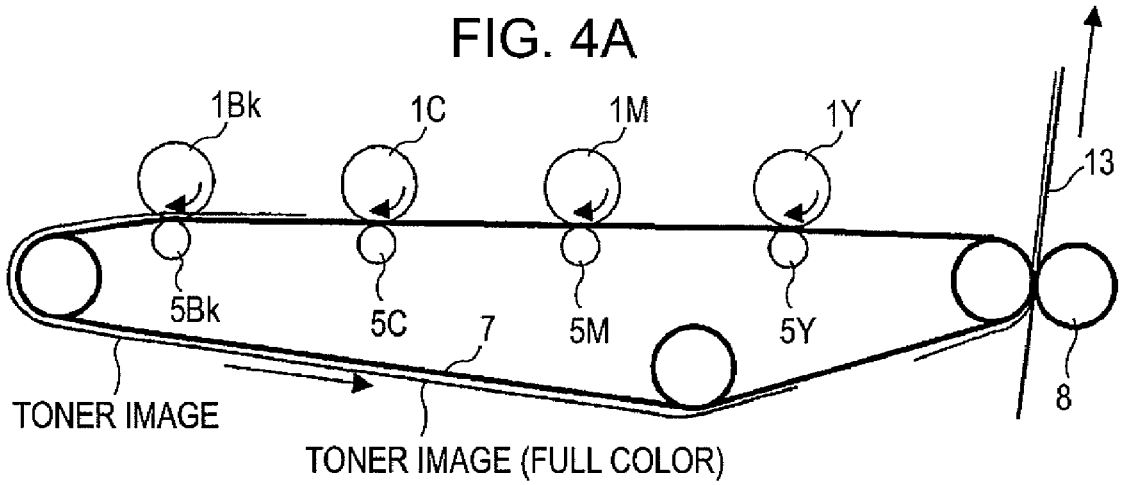
FIGS. 4A to 4C are diagrams showing operations according to an embodiment of the present invention.
Figure 4B:
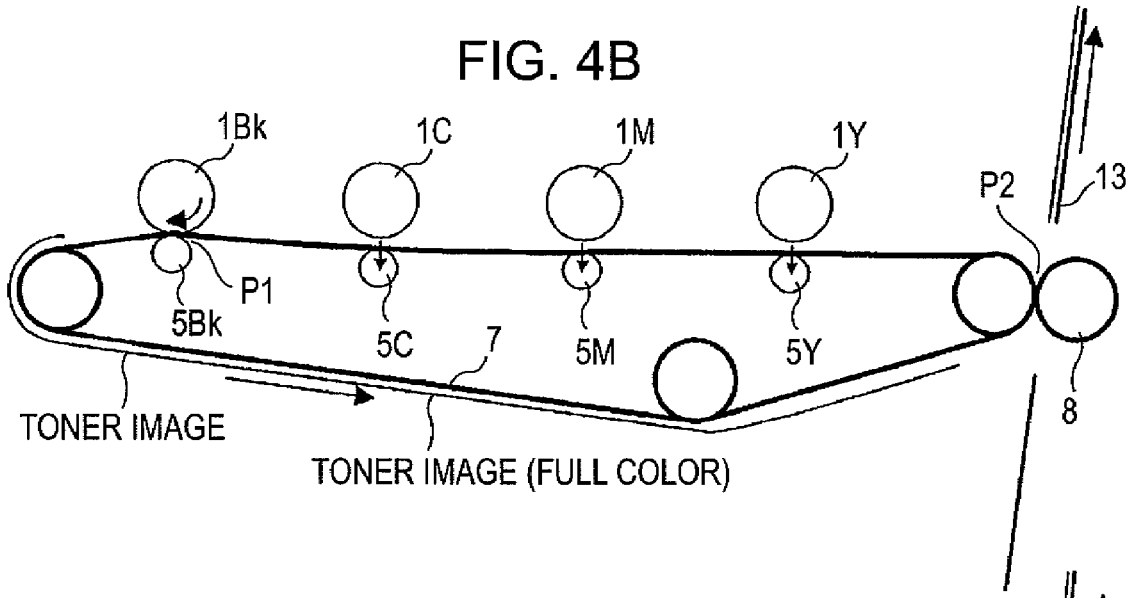
Figure 4C:
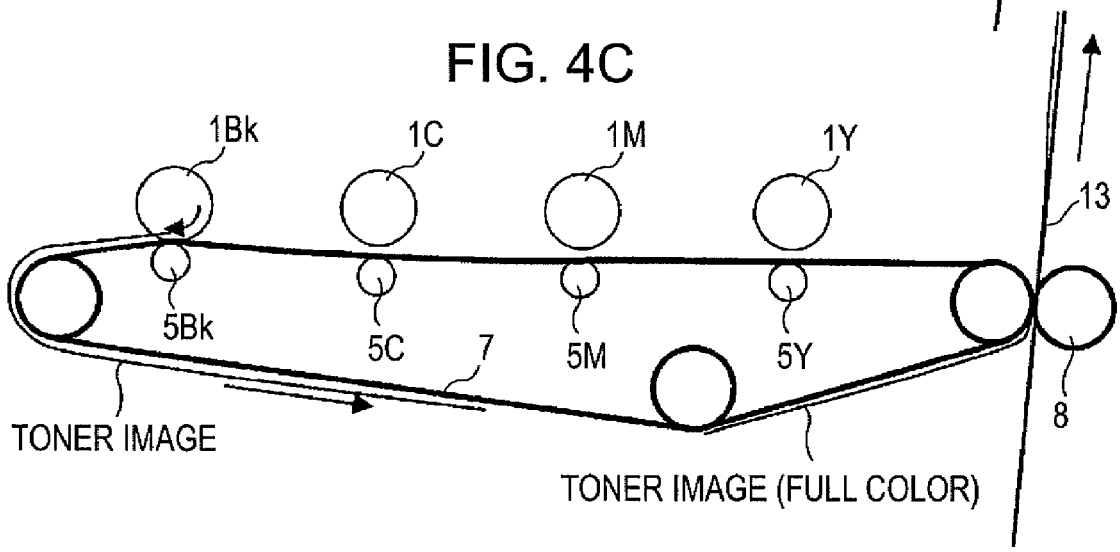

The controlling of the switching of the color mode has been described above for the case in which at the point of time when the first-transferring for the present image is completed, the interval between the present image and a previous image exists in the range A from the first transferring position P1 of the most downstream image forming station (Bk) to the second transferring position P2 (FIG. 4B).

Figure 5A:
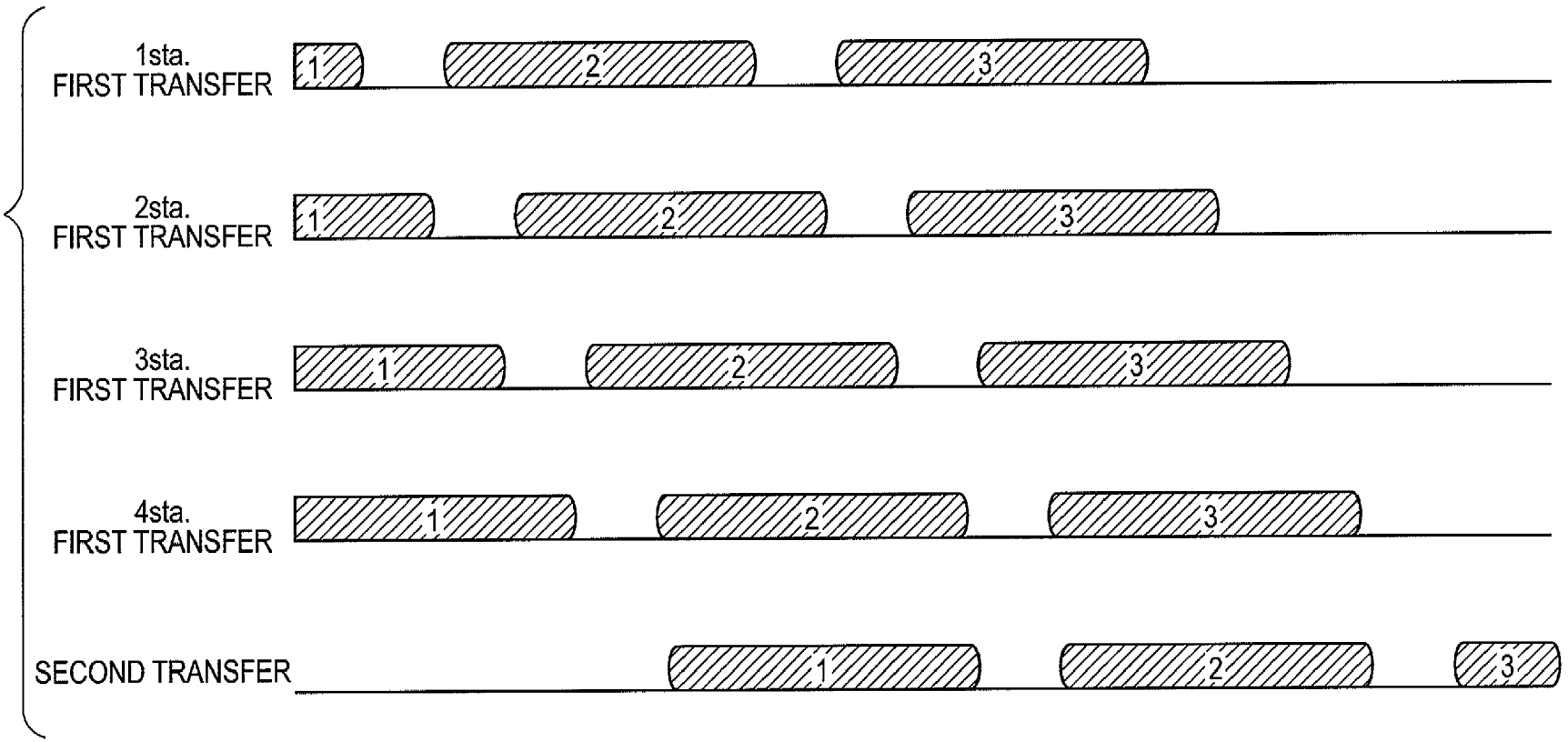
FIGS. 5A to 5C are diagrams showing an operation according to an embodiment of the present invention.
Figure 5B:
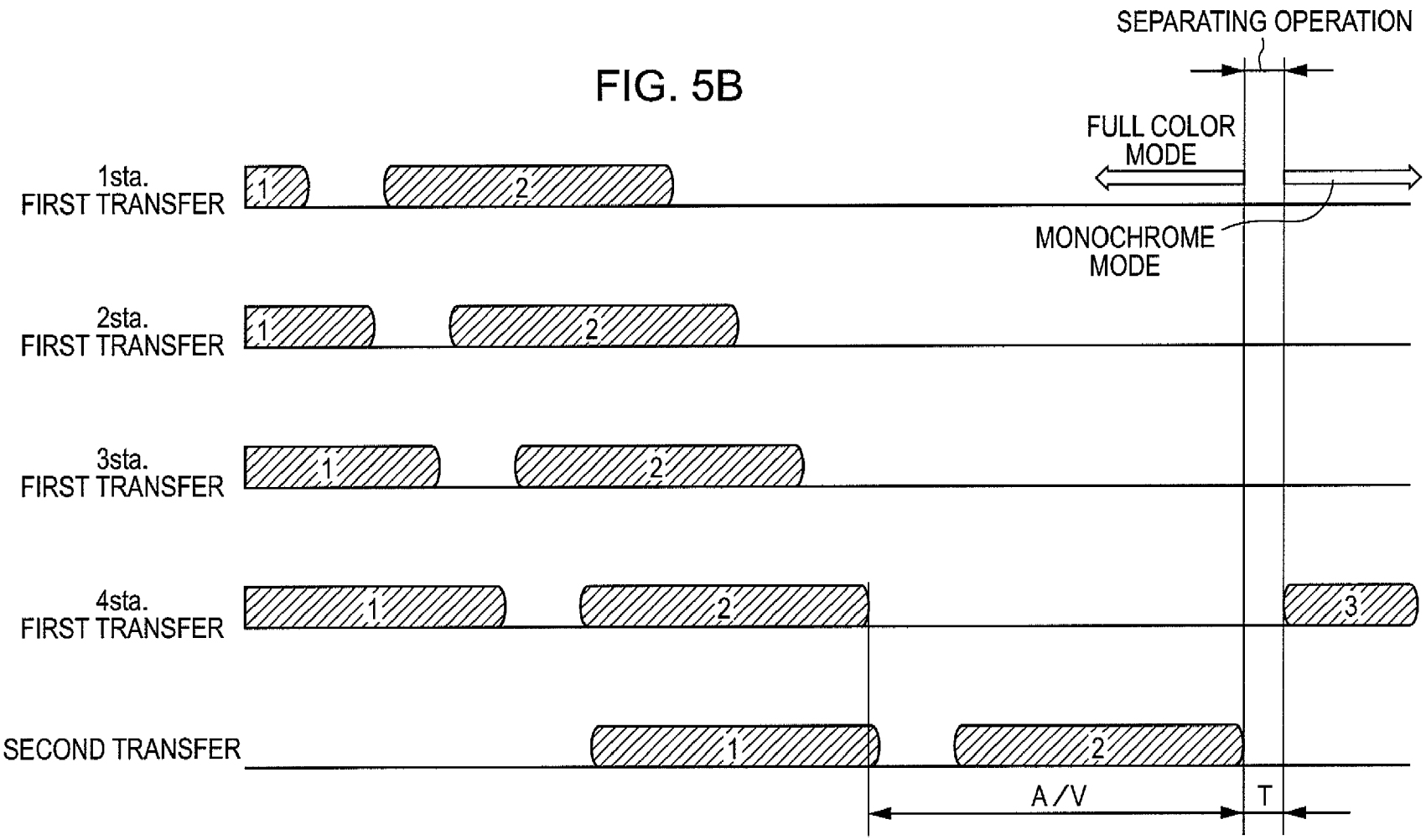
Figure 5C:
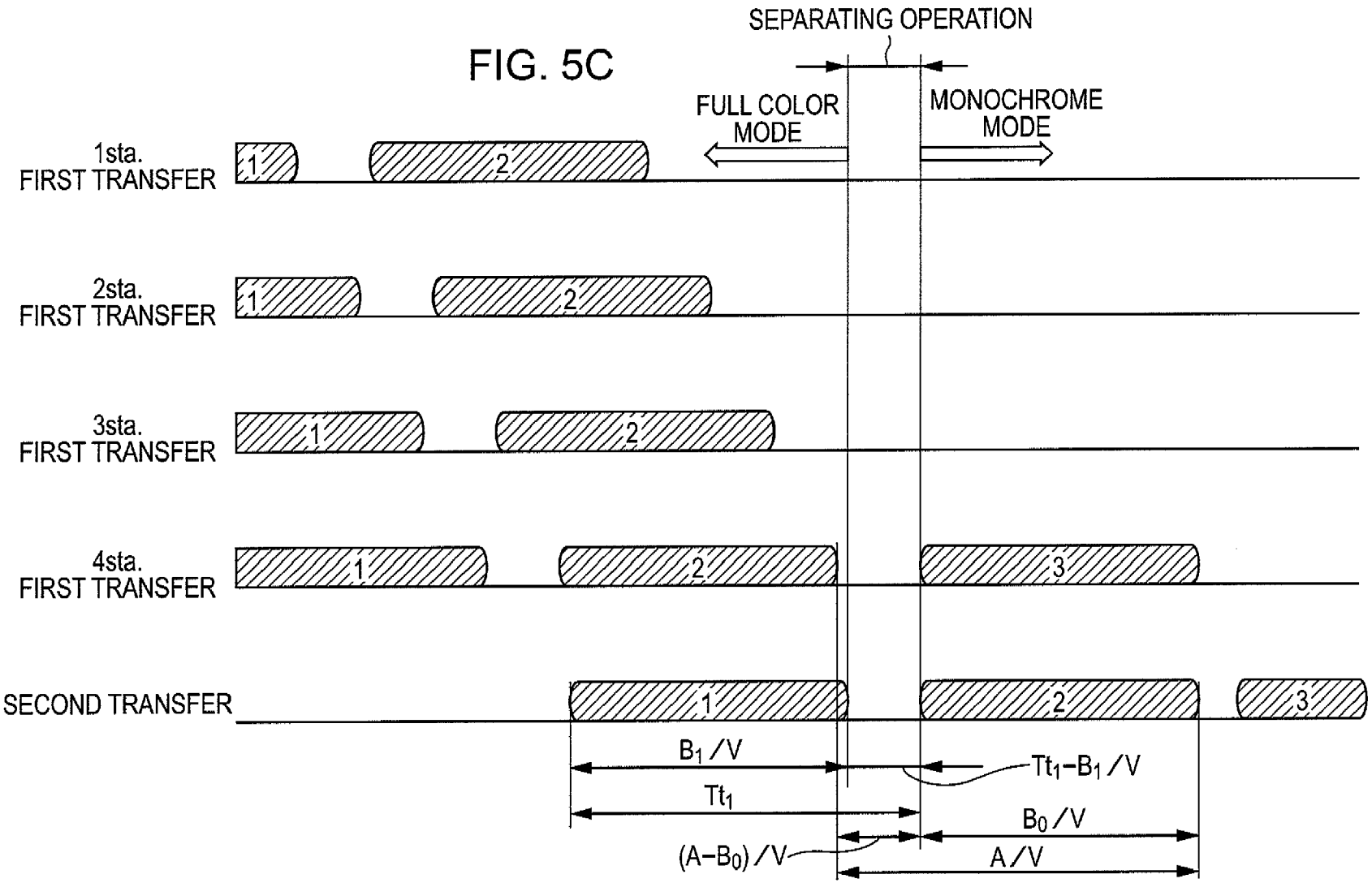

Referring to FIGS. 5A to 5C, a comparison in terms of the operation of switching the color mode from the full color mode to the single color mode is made between the conventional technique and the present embodiment in a printing operation in which three successive full color pages are printed.

In the switching of the color mode according to the conventional technique, switching between the single color mode and the full color mode is performed after the second transferring process is completed for all images in the current mode, and thus the minimum allowable interval between images becomes as large as A/V+T. If the switching from the full color mode to the single color mode is performed according to the conventional technique for the parameters employed in the present embodiment, then the time interval between images becomes as large as 3.9 sec (corresponding to a distance of 585 mm).

In contrast, in the present embodiment, the time interval corresponding to the physical interval between the present image and one-page previous image (Tt1−B1/V) is greater than the separating (contacting) operation time T, and thus the switching between the single color mode and the full color mode can be performed when this interval reaches the second-transferring position P2. If printing is started when the second-transferring process for the next image is started, the time interval corresponding to the physical image interval that occurs when the switching is perform is equal to Tt1−B1/V=0.6 sec. The distance corresponding to this time interval is equal to 90 mm, and thus the increase in the image interval that occurs when the mode is switched is greatly suppressed.

Also in the switching from the single color mode to the full color mode, the image interval is as small as Tt1−B1/V, and it is possible to start the first transferring process for a first image in the full color mode immediately when the second transferring process for the next image in the single color mode is started.

In the present embodiment, as described above, when printing is performed for a mixture of full color images and single color images, the waiting time at the color mode switching is minimized, and thus the reduction in throughput in the printing operation is minimized.

Second Embodiment

In the first embodiment described above, for the assumed dimensions of the parts and sizes of images, the controlling of the switching of the color mode has been described for the specific case in which one image exists in the range A from the first transferring position P1 of the most downstream image forming station (Bk) to the second transferring position P2. In a second embodiment described below, it is assumed that two or more images exist in the above range because the image size is small or because the distance A from the most downstream image forming station (Bk) to the second transferring position P2 is great. In the following discussion, the number of images existing in the above range is denoted by N. The hardware structure used in the present embodiment is similar to that used in the first embodiment, and a duplicated description thereof is not given herein.

In the present embodiment, the values of parameters are assumed as follows.

The distance from the first transferring position P1 of the most downstream image forming station (Bk) to the second transferring position P2 is A=600 mm.

The time needed to separate the color image forming stations from the second image carrying medium is T=0.4 sec.

The processing speed (the surface moving velocity of the second image carrying medium) is V=150 mm/sec.

The length of the last page in the full color mode before the color mode is switched from the full color mode to the single color mode is B0=120 mm.

The interval between the leading end of the last image in the full color mode and the leading end of the one-page previous image is Tt1=1.0 sec.

The length of the one-page previous image is B1=120 mm.

The interval between the leading end of the one-page previous image and the leading end of two-page previous image is Tt2=1.8 sec.

The length of the two-page previous image is B2=180 mm.

The interval between the leading end of the two-page previous image and the leading end of a three-page previous image is Tt3=1.2 sec.

The length of the three-page previous image is B3=150 mm.

Note that when the parameters are assumed to have the above-described values, A>B0 (A=600 mm and B0=120 mm).

First, the minimum value of N satisfying the following condition is determined.

$$A \leqq (Tt1+\ldots+TtN)\times V+B0$$

Because A=600 mm≦720 mm=(Tt1+Tt2+Tt3)×V+B0, the minimum value of N is 3. A comparison with the separation operation time T is then performed. If it is assumed that M=3 (=N), and T is compared with smaller one of the following values, $$(A-B0)/V-(Tt1+Tt3-1)=0.4 \text{ sec}$$

$$Tt3-B3/V=0.2 \text{ sec}$$

then $$T=0.4 \text{ sec}>0.2 \text{ sec}$$

Thus, the condition is not satisfied.

If it is assumed that M=2, then $$T=0.4 \text{ sec} \leqq Tt2B2/V=0.6 \text{ sec}$$

and thus the condition is satisfied.

Thus, it is determined that the maximum allowable value for M is 2. In other words, it is determined that the separating operation can be performed when the interval of the image that is two-page previous to the last page in the full color mode reaches the second transferring position.

Also in the case in which the color mode is switched from the single color mode to the full color mode, it is possible to determine optimum timing of performing the contacting operation after the first transferring process is completed for the last page in the single color mode.

As described above, when parameters are given as follows, the distance from the first transferring position P1 of the most downstream image forming station (Bk) to the second transferring position P2 is A, the time needed to separate the color image forming stations from the second image carrying medium is T, the length of the image being currently formed is B0, the interval between the leading end of the image being currently formed and the leading end of one-page previous image is Tt1, the interval between the leading end of an N−1 page previous image and the leading end of an N-page previous image is TtN, and the length of the N-page previous image is BN, it is determined whether the minimum allowable value of N satisfying the following condition:

$$A \leqq (Tt1 + \ldots + TtN) \times V + B0$$

If such a value for N (≧0) is detected, there are N image-to-image intervals on the second image carrying medium at the point of time at which the first transferring process is completed for the image being currently formed. In a case in which there is no value of N satisfying the above condition and there are L (<N) images, there are L image-to-image intervals and an interval between the leading end of an image at a top position and the second transferring position. When the color mode is switched from the full color mode to the single color mode in such a situation, intervals greater than the separating operation time T are detected, and furthermore an interval of these detected intervals that first reaches the second transferring position is detected. The color image forming stations are separated when this interval reaches the second transferring position P2. On the other hand, in the case in which the color mode is switched from the single color mode to the full color mode, intervals greater than the separating operation time T are detected, and the color image forming stations are separated from the second image carrying medium when one of these intervals first reaches the second transferring position P2.

Third Embodiment

In the first embodiment described above, if the length P of the transferring medium is 420 mm and the length of an image is 405 mm, the image with the length of 405 mm is transferred to the transferring medium. Thus, in a third embodiment described herein, the control of the operation is performed not based on the paper size but based on the image length.

If it is assumed that the image length is equal to B0r=B1r=405 mm, then $$A = 525\text{ mm} \geqq 405\text{ mm} = B0r$$

First, the minimum value of N satisfying the following condition is determined.

$$A \leqq (Tt1 + \ldots + TtN) \times V + B0r$$

Because $$A = 525\text{ mm} \leqq 915\text{ mm} = (Tt1) \times V + B0r$$

and thus the minimum value of N is 1. A comparison with the separation (contacting) operation time T is then performed. If it is assumed that M=1 (=N), and T is compared with smaller one of the following values, $$(A - B0)/V = 0.8\text{ sec}$$

$$Tt1 - B1/V = 0.7\text{ sec}$$

then $$T = 0.4\text{ sec} \leqq Tt1 - B1r/V = 0.7\text{ sec}$$

Thus, the color image forming stations are separated from (brought into contact with) the second image carrying medium when the interval for an M (=1)-page previous page reaches the second-transferring position P2.

In a case in which the present operation status is that the first transferring process is completed for the image of the first page and there is no previous image, T satisfies the following condition.

$$T = 0.4\text{ sec} \leqq (A - B0r)/V = 0.8\text{ sec}$$

That is, the time needed for the first-transferred image to reach the second-transferring position is 0.8 sec, which is greater than T. Thus, the separating operation is immediately performed.

If the condition is not satisfied, the separating (contacting) operation is performed after the second transferring process is completed for all images.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

What is claimed is:

1. An image forming apparatus comprising:

a plurality of image forming stations, each image forming station configured to form a different color toner image;

first transferring parts and an image carrying medium, the first transferring parts configured to sequentially transfer the color toner images formed by the respective image forming stations to the image carrying medium;

a second transferring part configured to transfer, in a second transfer process, the color toner images on the image carrying medium to a recording medium; and a controller configured to selectively switch a color mode between a full color mode, in which all image forming stations are in contact with the image carrying medium and a full color image using plural color toner images is formed on the image carrying medium, and a single color mode, in which one of the plural image forming stations is in contact with the image carrying medium and a single color image using a single color toner image is formed on the image carrying medium, wherein the controller controls the switching of the color mode from the single color mode to the full color mode based on the interval between an image of interest and an immediately previous image after the second transferring process for the immediately previous image is completed and before the second transferring process for the image of interest is started and in a state in which the first transferring parts and the second transferring part are not in operation, and wherein the controller determines whether a time needed for the interval between the image of interest and the immediately previous image to pass through the second transferring part is longer than a time needed to bring the image forming stations into contact with the image carrying medium, and when the controller determines that the time needed for the interval between the image of interest and the previous image to pass through the second transferring part is longer, the controller controls the switching of the color mode from the single color mode to the full color mode after the second transferring process for the immediately previous image is completed and before the second transferring process for the image of interest is started.

2. An image forming method of an image forming apparatus having a plurality of image forming stations, each image forming station configured to form a different color toner image, first transferring parts and an image carrying medium, the first transferring parts configured to sequentially transfer the color toner images formed by the respective image forming stations to the image carrying medium, and a second transferring part configured to transfer, in a second transfer process, the color toner images on the image carrying medium to a recording medium, comprising:

selectively switching a color mode between a full color mode, in which all image forming stations are in contact with the image carrying medium and a full color image using plural color toner images is formed on the image carrying medium, and a single color mode, in which one of the plural image forming stations is in contact with the image carrying medium and a single color image using a single color toner image is formed on the image carrying medium, wherein the switching of the color mode from the single color mode to the full color mode is based on the interval between an image of interest and an immediately previous image after the second transferring process for the immediately previous image is completed and before the second transferring process for the image of interest is started and in a state in which the first transferring parts and the second transferring part are not in operation; and determining whether a time needed for the interval between the image of interest and the immediately previous image to pass through the second transferring part is longer than a time needed to bring the image forming stations into contact with the image carrying medium, and when it is determined that the time needed for the interval between the image of interest and the previous image to pass through the second transferring part is longer, the color mode is switched from the single color mode to the full color mode after the second transferring process for the immediately previous image is completed and before the second transferring process for the image of interest is started.

* * * * *